US006164214A

United States Patent [19]

Smorgon et al.

[11] Patent Number: 6,164,214

[45] Date of Patent: Dec. 26, 2000

[54] PALLET WITH NON-SLIP LOAD-CARRYING AND GROUND-ENGAGING SURFACES

[75] Inventors: Victor Smorgon, Laverton North; Lazer Berelovich, Elsternwick, both of Australia

[73] Assignee: Vicfam Plastics Pty Ltd, Laverton North, Australia

[21] Appl. No.: 09/230,330

[22] PCT Filed: Jun. 17, 1997

[86] PCT No.: PCT/AU97/00382

§ 371 Date: Apr. 22, 1999

§ 102(e) Date: Apr. 22, 1999

[87] PCT Pub. No.: WO98/03408

PCT Pub. Date: Jan. 29, 1998

[30] Foreign Application Priority Data

Jul. 22, 1996 [AU] Australia ..... PO 1161

[51] Int. Cl.[7] ..... B65D 19/38

[52] U.S. Cl. ..... 108/53.5; 108/57.28; 108/57.29; 108/901

[58] Field of Search ..... 108/53.1, 55.3, 108/57.25, 57.28, 57.29, 901, 53.5

[56] References Cited

U.S. PATENT DOCUMENTS

| | | | |
|---|---|---|---|
| 3,702,100 | 11/1972 | Wharton | 108/901 X |
| 3,762,342 | 10/1973 | Lawlor | 108/901 X |
| 4,000,704 | 1/1977 | Griffin, Jr. | 108/53.1 |
| 4,254,873 | 3/1981 | Cook, III et al. | 108/53.1 X |
| 4,301,743 | 11/1981 | Keller | 108/53.1 |
| 4,580,680 | 4/1986 | Wind | 108/55.3 X |
| 4,838,176 | 6/1989 | Bowser, Sr. et al. | 108/901 X |
| 4,865,202 | 9/1989 | Day | 108/53.1 X |
| 5,606,921 | 3/1997 | Elder et al. | 108/53.3 |

FOREIGN PATENT DOCUMENTS

| | | |
|---|---|---|
| 1781334A1 | 12/1970 | Germany . |
| 2525868A1 | 9/1976 | Germany . |
| 2733456A1 | 2/1979 | Germany . |
| 3806069A1 | 9/1988 | Germany . |
| 1414638A | 11/1975 | United Kingdom . |
| WO94/20377A1 | 9/1995 | WIPO . |

OTHER PUBLICATIONS

Derwent Abstract Accession No. 89–198374/27, Jun. 16, 1989.

*Primary Examiner*—Peter M. Cuomo
*Assistant Examiner*—Hanh V. Tran
*Attorney, Agent, or Firm*—Harness, Dickey & Pierce

[57] ABSTRACT

A pallet having a load-carrying surface (2) constructed of a substantially flat impervious material having a multiplicity of upstanding projections to prevent slippage on the surface while permitting cleaning of the surface. A ground-engaging part (8) of the pallet has at its underside an array of apertures so configured that when two like pallets are arranged in stacked configuration the projections on the load-carrying surface of a lower one of the pallets will engage within the apertures in the ground-engaging part of the upper of the two pallets to prevent slippage of the upper pallet relative to the lower pallet. Preferably, the ground engaging part of the pallet includes an array of substantially parallel reinforcing ribs (10) and the apertures are defined between adjacent ribs.

6 Claims, 3 Drawing Sheets

PALLET WITH NON-SLIP LOAD-CARRYING AND GROUND-ENGAGING SURFACES

The present invention relates to pallets and more particularly to pallets which can easily be cleaned.

Most pallets currently in use are constructed of wood, with the load-carrying platform of the pallet being defined by a series of spaced wooden planks. Conventional wooden pallets are liable to accumulate dirt and other contaminants during use which can become embedded into the surface structure of the wood with the result that it can be very difficult to properly clean the pallet by a normal housing or steam cleaning operation after use. This is unsatisfactory when the pallet is used to carry foodstuffs, pharmaceutical, or medical products or other products sensitive to contamination by dirt or bacteria.

In our International patent application No. PCT/AU95/00690 there is disclosed a pallet of one-piece moulded plastics construction having a solid load-carrying platform with a plurality of upstanding projections. The projections are intended to grip onto the surface of for example a cardboard container or a shrink wrapped plastics container to prevent slippage on the platform. The projections are also so arranged on the platform as to permit thorough cleaning of the platform including the projections by hosing or steam cleaning. The underside configuration of the pallet is also such as to permit ease of cleaning. Although this pallet operates effectively and is capable of being effectively cleaned, when several of the pallets are stacked one on top of another there is a risk slippage of individual pallets of the stack when the stack is being moved, for example on the tines of a forklift truck.

According to the present invention, there is provided a pallet having a load-carrying surface which is constructed of a substantially flat impervious material having a multiplicity of upstanding projections to prevent slippage on the surface while permitting cleaning of the surface, and a ground-engaging part of the pallet has at its underside an array of apertures so configured that when two like pallets are arranged in stacked configuration the projections on the platform of a lower one of the pallets will engage within the apertures in the ground-engaging surface of the upper of the two pallets whereby to prevent slippage of the rubber pallet relative to the lower pallet.

In the preferred embodiment of the invention the ground-engaging part of the pallet is defined by two or more struts with ribs at their underside to provide reinforcement, the apertures being defined between adjacent ribs.

In the preferred embodiment the upstanding projections are defined by a series of raised lips which form a polygonal shape or a rounded shape or a mixture of rounded and polygonal shapes.

In the preferred embodiment the projections are distributed uniformly throughout the load-carrying surface, and the apertures are distributed throughout the ground-engaging part.

An embodiment of the invention will now be described, by way of example only, with reference to the accompanying drawings, in which.

As shown in the accompanying drawings a pallet in accordance with the preferred embodiment of the invention is constructed of plastics and has a continuous, substantially flat, load-carrying platform 2. The load-carrying platform 2 is provided with a multiplicity of upstanding projections 4, uniformly distributed over its entire surface, the projections 4 being formed integrally with the platform 2. The projections 4 on the otherwise flat and smooth load-carrying platform 2 enable the projections to grip the surface of a container on the platform, for example a cardboard container or a shrink wrapped plastics container.

The load-carrying platform 2 is supported by an underlying support structure consisting of a series of parallel beams 6, the two outer beams 6 defining outside walls of the pallet. The lower edges of the beams 6 are interconnected by a series of transverse struts 8 which define the ground-engaging surface of the pallet. The beams 6 are spaced to define an access for the tines of the forklift truck from either of the two open ends of the pallet. The beams 6 defining the opposed outer side walls of the pallet may be apertured to permit entry of the forklift tines from either of the two opposed sides thereby providing four-way entry for the tines. The outer edges 8*a* of the outermost struts 8 are included to define ramps to facilitate movement onto the upper surface of the struts of wheels at the underside of the tines of a hand operated forklift trolley.

Preferably, the overall pallet consisting of the load-carrying platform 2 and the supporting structure defined by the beams 6 and transverse struts 8 is moulded in one piece in a suitable plastics, for example post-consumer recycled plastics, although other plastics may also be used.

Figure 1:
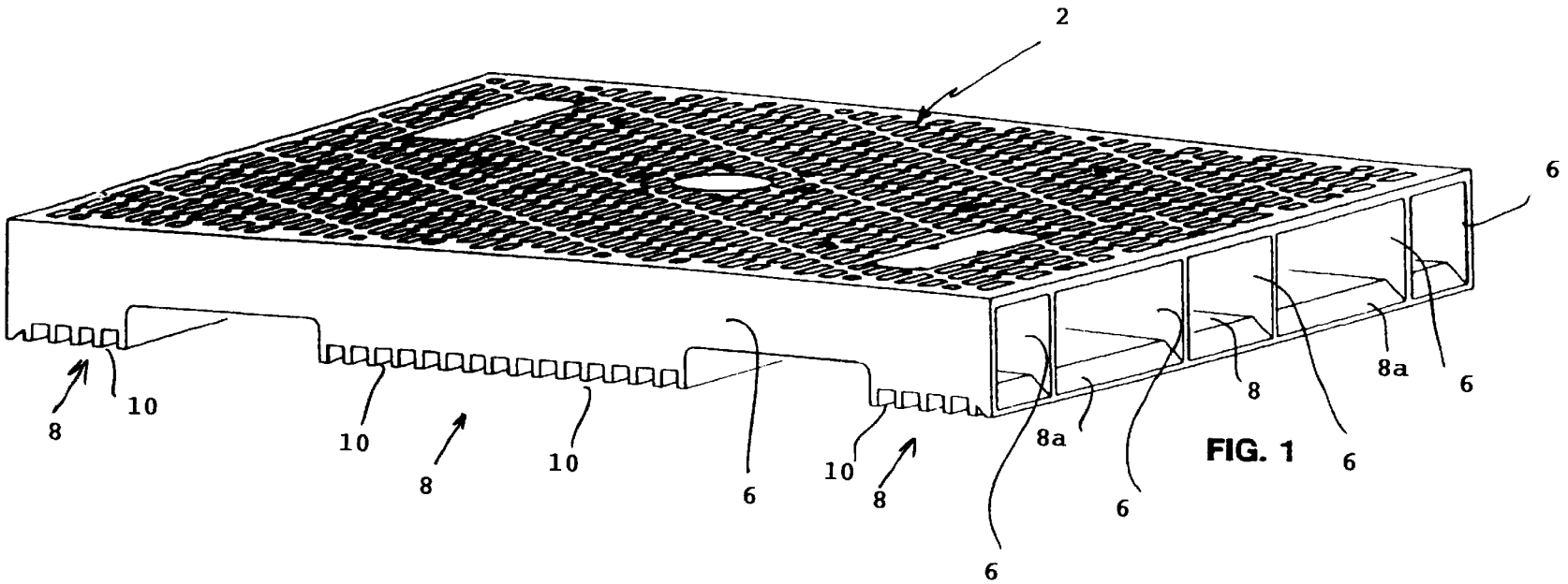
FIG. 1 is a perspective view from one end of the pallet in accordance with a preferred embodiment of the invention.
Figure 2:
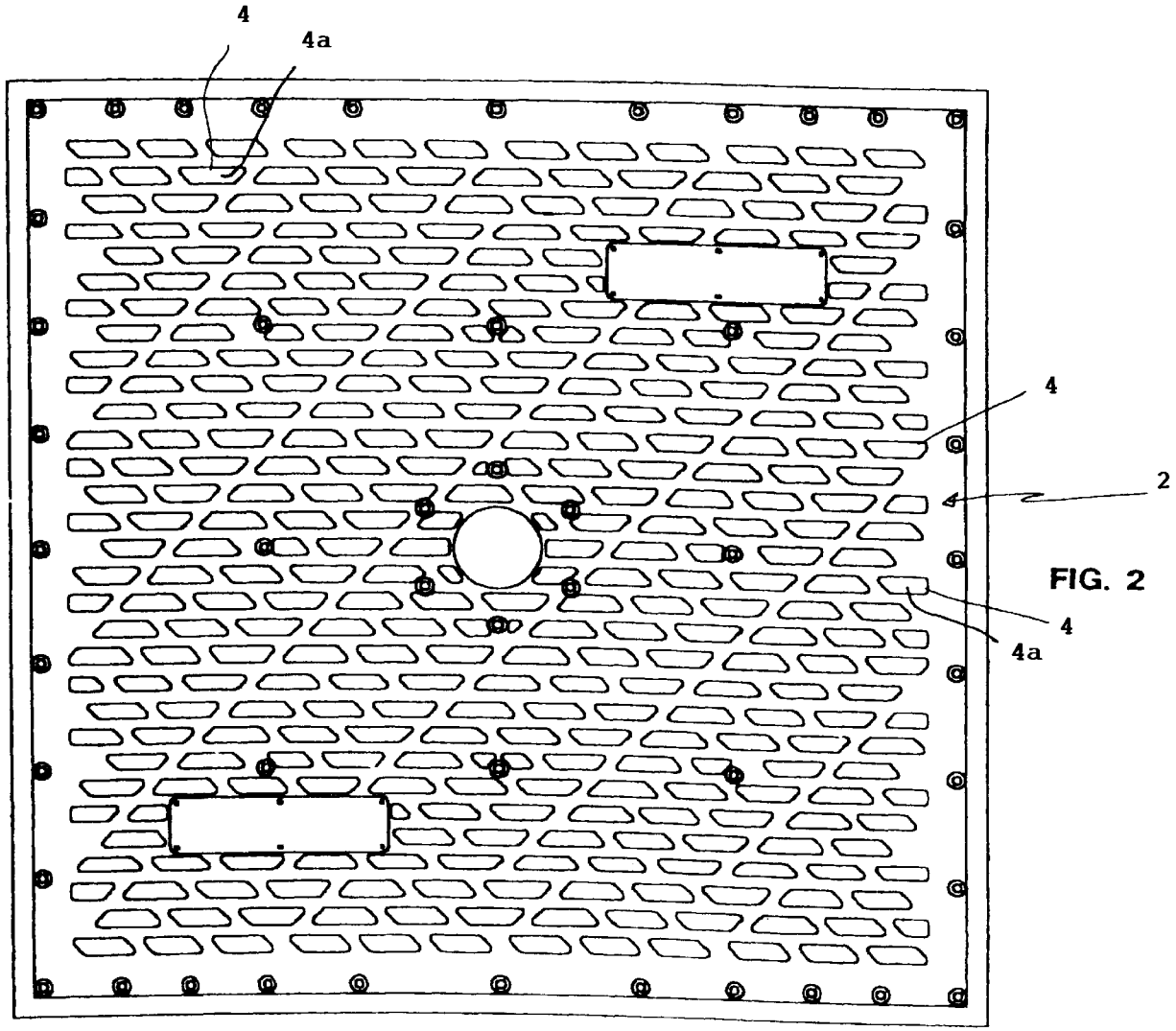
FIG. 2 is a plan view of the pallet.
Figure 3:
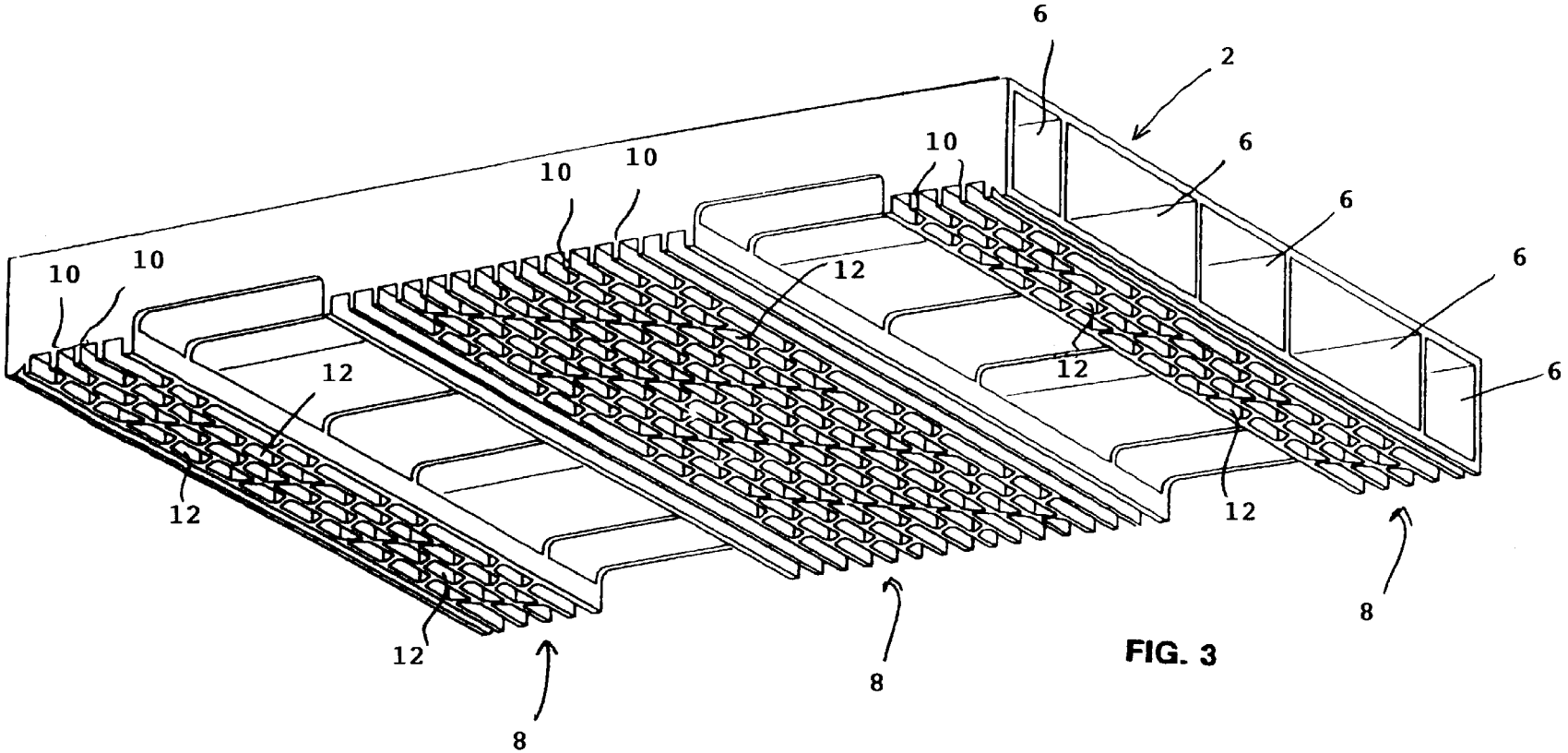
FIG. 3 is an underneath view of the pallet.

The underside of each of the struts 8 is formed with a series of longitudinally-extending parallel ribs 10 to provide increased rigidity against bowing of the struts and hence bowing of the pallet in a direction transversely to the beams 6. It will be noted from FIG. 3 that the adjacent ribs 10 at the underside of each strut 8 are interconnected by a series of transverse webs to provide a pattern of apertures 12. It will also be noted from FIG. 1 and 2 that the upstanding projections 4 on the load-carrying platform 2 define a continuous upstanding lip in the form of a four sided figure which as shown is either a parallelogram or a trapezium, the continuous lip bounding flat internal area 4*a* of the platform. The apertures 12 defined within the ribs 10 of the underside of the struts 8 are so configured that when two like pallets are stacked one on another the upstanding lips of the projections 4 on the platform 2 of the lower pallet will engage within the recesses 12 at the underside of the struts 8 of the upper pallet, with the ribs 10 are interconnecting webs of the struts 8 lying in contact with the flat surface areas of the platform surrounding the projections 4. As a result, the two pallets are interlocked sufficiently to prevent slippage.

Although as shown the upstanding lips on the platform are in the form of four sided figures of parallelogram or trapezium shape, they may be of other shape for example other polygonal shape or a rounded shape such as a circular, elliptical, or oval shape. Although as shown each of the upstanding lips is continuous it may alternatively be interrupted.

As will be apparent, when other shapes of lips are used on the upper surface of the platform 2, the apertures 12 defined between the ribs 10 at the underside of the struts 8 are appropriately configured to receive the differently shaped lips. It will be apparent in this regard that the apertures 12 within the ribs 10 do not have to be of the same shape as the upstanding lips but merely have to be such as to receive those lips and co-operate with them to prevent slippage. For example in the case of lips which are of circular shape, apertures within the ribs of an appropriately sized square shape can receive the circular lips of an underlying pallet and engage them at four diametrically-opposed points in order to prevent slippage.

In the pallet of the invention the upstanding lips on the load-carrying surface of the platform provide gripping characteristics for the surface without impeding the ability to effectively clean the surface due to the substantial flat areas of the platform which surround and lie within the individual lips. However these lips also enable a substantial non-slip stacking characteristic by co-operation with the formation of apertures incorporated within the array of reinforcing ribs at the underside of the pallet.

The embodiment has been described by way of example only and modifications are possible within the scope of the invention.

What is claimed is:

1. A pallet having a load-carrying surface in the form of a continuous platform which is constructed of a substantially flat impervious material having a multiplicity of upstanding projections to prevent slippage on the surface while permitting clean of the surface, parallel beams at the underside of the surface, transverse struts extending across the lower edges of the beams to define a ground-engaging surface of the pallet, the underside of the struts having a series of parallel ribs to enforce the struts, said ribs defining at the underside of the pallet an array of apertures so configured that when two like pallets are arranged in stacked configuration the projections on the platform of a lower one of the pallets will engage within the apparatus at the underside of the upper of the two pallets whereby to prevent slippage of the upper pallet relative to the lower pallet and wherein the ribs are interconnected by short transverse webs and the respective apertures are defined between a pair of adjacent ribs and a pair of adjacent webs.

2. A pallet according to claim 1, wherein each projection is formed by a raised lip comprising a perimeter of said projection.

3. A pallet according to claim 2, wherein the raised lips each define a substantially closed figure of a polygonal shape or a rounded shape.

4. A pallet according to claim 2, wherein the area bounded within the perimeter of said projection is substantially flat.

5. A pallet according to claim 1, wherein the projections are distributed throughout the load-carrying surface and the apertures are distributed throughout the underside of the struts.

6. A pallet according to claim 1, wherein the pallet is of one-piece moulded plastic construction.

* * * * *

UNITED STATES PATENT AND TRADEMARK OFFICE

CERTIFICATE OF CORRECTION

PATENT NO : 6,164,214

DATED : December 26, 2000

INVENTOR(S) : Smorgon et al.

It is certified that error appears in the above-identified patent and that said Letters Patent are hereby corrected as shown below:

Column 3, line 20, Delete "clean" and insert --cleaning--

Column 3, line 24, Delete "enforce" and insert --reinforce--

Column 4, line 3, Delete "apparatus" and insert --apertures--

Column 4, line 3, After "at the underside" insert --surface--

Signed and Sealed this

First Day of May, 2001

*Attest:*

Nicholas P. Godici

NICHOLAS P. GODICI

*Attesting Officer*

*Acting Director of the United States Patent and Trademark Office*